US011808100B2

(12) United States Patent
Wai et al.

(10) Patent No.: US 11,808,100 B2
(45) Date of Patent: Nov. 7, 2023

(54) TUBULAR CUT MONITORING SYSTEMS AND METHODS TO CUT A TUBULAR

(71) Applicant: Halliburton Energy Services, Inc., Houston, TX (US)

(72) Inventors: Simon Whye Kwong Wai, Singapore (SG); Adriell Chuan Nan Phoe, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/687,511

(22) Filed: Mar. 4, 2022

(65) Prior Publication Data

US 2023/0279733 A1 Sep. 7, 2023

(51) Int. Cl.
*E21B 29/00* (2006.01)
*E21B 47/00* (2012.01)

(52) U.S. Cl.
CPC ..... *E21B 29/002* (2013.01); *E21B 47/00* (2013.01)

(58) Field of Classification Search
CPC ..... E21B 29/002; E21B 29/08; E21B 47/007
See application file for complete search history.

(56) References Cited

U.S. PATENT DOCUMENTS 4,903,245 A 2/1990 Close et al.
6,975,112 B2 12/2005 Morys et al.
2009/0250264 A1 10/2009 Dupriest
2013/0341090 A1 12/2013 Zeineddine et al.
2018/0283161 A1 10/2018 Bailey et al.

FOREIGN PATENT DOCUMENTS

CA 2752759 A1 * 8/2010 ..... E21B 17/042
EP 1693549 A1 8/2006
WO 2021-055010 A1 3/2021

OTHER PUBLICATIONS

International Search Report and Written Opinion in PCT/US2022/022065, dated Nov. 25, 2022.

* cited by examiner

*Primary Examiner* — Zakiya W Bates
(74) *Attorney, Agent, or Firm* — Barnes & Thornburg, LLP

(57) ABSTRACT

Tubular cut monitoring systems and methods to cut a tubular are presented. The method includes running a downhole cutting tool to a location in a tubular. During a cutting operation, the method also includes monitoring, with an inertial sensor of the downhole cutting tool, for stick slip vibrations produced by a cutter blade of the downhole cutting tool. The method further includes determining whether a total number of stick slip vibrations produced by the cutter blade within a threshold number of revolutions of the cutter blade is greater than a threshold number of tolerable stick slip vibrations. In response to a determination that the total number of stick slip vibrations produced by the cutter blade within the threshold number of revolutions is greater than the threshold number of tolerable tick slip vibrations, the method further includes ceasing the cutting operation.

17 Claims, 5 Drawing Sheets

TUBULAR CUT MONITORING SYSTEMS AND METHODS TO CUT A TUBULAR

BACKGROUND

The present disclosure relates generally to tubular cut monitoring systems and methods to cut a tubular.

Tubulars, such as strings, pipes, coiled tubing, and production tubing are often run into a wellbore to provide an interior passageway for fluids, tools, equipment, and other materials to travel from the surface downhole, and from a downhole location to the surface while insolating and protecting the fluids, tools, equipment, and other materials. A tubular is sometimes first run into the wellbore, and a downhole cutting is subsequently run into the wellbore to perform one or more cuts to the tubular.

BRIEF DESCRIPTION OF THE DRAWINGS

Illustrative embodiments of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to tubular cut monitoring systems and methods to cut a tubular. A downhole cutting tool is run downhole to a desired downhole location of a tubular to perform a cutting operation. During the cutting operation, an inertial sensor (such as an accelerometer, a gyroscope, or another type of inertial sensor) of the downhole cutting tool is utilized to monitor for stick slip vibrations produced by a cutter blade performing the cutting operation. In some embodiments, the inertial sensor is utilized to determine a velocity magnitude of the cutter blade and a change in the velocity magnitude of the cutter blade. Data indicative of the velocity magnitude of the cutter blade, the change in the velocity magnitude, and other data related to the cutting operation (collectively referred to as "cutting operation data") is provided to the tubular monitoring system in real-time.

Figure 1:
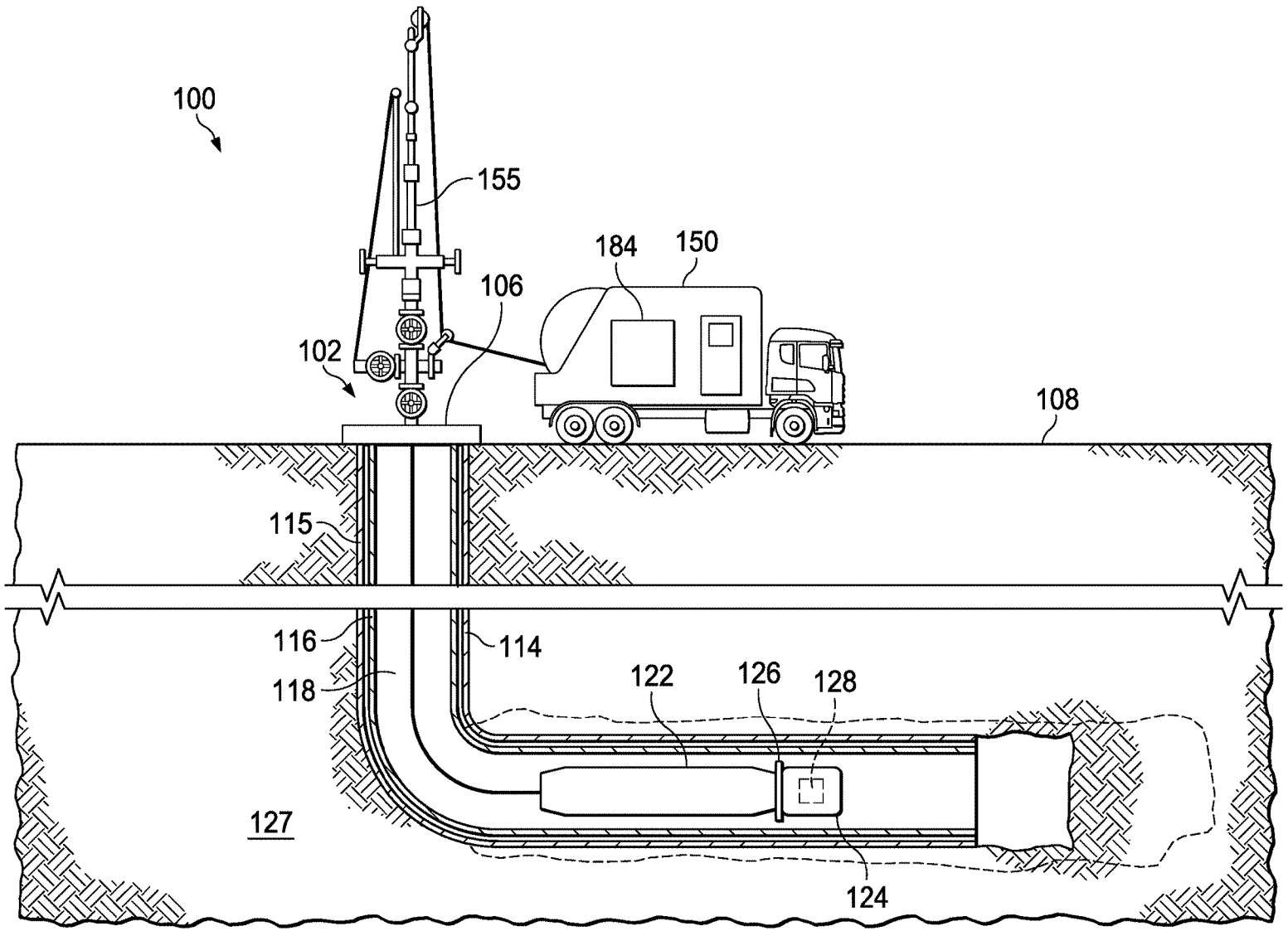
FIG. 1 is a schematic, side view of a completion environment that includes a wellbore having a downhole cutting tool deployed in a tubular to perform a cutting operation.

During the cutting operation, the tubular cut monitoring system, such as tubular cut monitoring system 184 of FIG. 1, determines, based on the cutting operation data, the number of stick slip vibrations produced by the cutter blade within a threshold number of revolutions of the cutter blade. In some embodiments, the tubular cut monitoring system determines an occurrence of stick slip vibration based on a change in the velocity magnitude of the cutter blade. For example, the tubular cut monitoring system determines that a stick slip vibration was produced by the cutter blade if the velocity magnitude of the cutter blade increases from below a first threshold velocity magnitude (e.g., 5 millimeters per second) to above a second threshold velocity magnitude (e.g., above 20 millimeters per second). For example, the tubular cut monitoring system determines that stick slip vibration was produced by the cutter blade if the velocity magnitude of the cutter blade increased from 3 millimeters per second to 22 millimeters per second. In one or more of such embodiments, the tubular cut monitoring system determines an occurrence of a stick slip vibration if the velocity magnitude of the cutter blade was below the first threshold velocity magnitude (e.g., 5 millimeters per second) for a threshold period of time (e.g., more than 0.2 seconds) before increasing to above the second threshold magnitude (e.g., 20 millimeters per second). In some embodiments, the tubular cut monitoring system determines an occurrence of a subsequent stick slip vibration if the vibration magnitude of the cutter blade decreases from above the second threshold magnitude to below the first threshold magnitude before increasing to above the second threshold magnitude. Continuing with the foregoing example, the cut monitoring system determines a second occurrence of stick slip vibration if the velocity magnitude of the cutter blade decreases from 22 millimeters per second to 4 millimeters per second, and increases from 4 millimeters per second to 24 millimeters per second. In one or more of such embodiments, the tubular cut monitoring system determines subsequent of a subsequent stick slip vibration if the velocity magnitude of the cutter blade decreased from above the first threshold velocity magnitude to below the first threshold velocity magnitude, remained below the firs threshold velocity magnitude for a threshold period of time before again increasing to above the second threshold magnitude. Additional descriptions of determining the occurrence of stick slip vibrations are provided in the paragraphs below and are illustrated in at least FIGS. 3A-3B.

The tubular cut monitoring system dynamically determines whether the number of stick slip vibrations produced by the cutter blade is greater than a threshold number of tolerable stick slip vibrations within the threshold number of revolutions of the cutter blade. For example, where the threshold number of revolutions is ten revolutions, and where the threshold number of tolerable stick slip vibrations is three stick slip vibrations, the tubular cut monitoring system counters (such as via a counter initially set at zero) each time the cutter blade produces a stick slip vibration during the ten revolutions. In one or more of such embodiments, the tubular cut monitoring system increments (e.g., increments the counter) each time the cutter blade produces a stick slip vibration until the total number of stick slip vibrations produced by the cutter blade is greater than three stick slip vibrations or another threshold number of tolerable stick slip vibrations during the ten cutter blade revolutions (or during another threshold number of cutter blade revolutions), or until after the cutter blade has made ten cutter blade revolutions (or another threshold number of cutter blade revolutions).

The tubular cut monitoring system, in response to a determination that the total number of stick slip vibrations produced by the cutter blade within the threshold number of revolutions is greater than the second threshold number of tolerable stick slip vibrations, requests the cutter blade to cease the cutting operation. Continuing with the foregoing example, the tubular cut monitoring system in response to a determination that the cutter blade has produced four stick slip vibrations after three revolutions, requests the cutter blade to cease operation to prevent damage to the cutter blade. Alternatively, the tubular cut monitoring system, in response to a determination that the cutter blade did not produce more than the threshold number of tolerable stick slip vibrations during the threshold number of revolutions, repeats the foregoing process until the cutting operation is complete. In one or more of such embodiments, the tubular cut monitoring system resets the counter to zero if the total number of stick slip vibrations during the ten revolutions of the cutter blade (or during another threshold number of revolutions) is not greater than three stick slip vibrations (or greater than another threshold number of revolutions), and the foregoing process is repeated for each threshold number of revolutions of the cutter blade until the cutting operation is complete. In some embodiments, the tubular cut monitoring system dynamically provides data indicative of the cutting operation including, but not limited to, the current status of the cutting operation, the velocity magnitude of the cutter blade, the total number of stick slip vibrations produced by the cutter blade within the threshold number of revolutions for display, as well as other cutting operation data for display to an operator.

In some embodiments, the tubular cut monitoring system, after requesting the cutter blade to cease performing a cutting operation due to detecting too many stick slip vibrations within the threshold number of revolutions of the cutter blade, requests the cutter blade to restart the cutting operation, and the operations described herein to monitor and detect stick slip vibrations are repeated. In one or more of such embodiments, the tubular cut monitoring system adjusts the threshold number of tolerable stick slip vibrations within the threshold number of revolutions of the cutter blade to reduce the likelihood of damage to the cutter blade. For example, where the threshold number of stick slip vibrations was three stick slip vibrations per ten revolutions of the cutter blade, the tubular cut monitoring system reduces the threshold number to one stick slip vibration per ten revolutions of the cutter blade. In some embodiments, the tubular cut monitoring system also adjusts the threshold number of revolutions of the cutter blade.

In some embodiments, after completion of a cutting operation, the downhole cutting tool is run to a second desired location to perform a second cutting operation. In one or more of such embodiments, the operations described herein to monitor and detect stick slip vibrations are performed again. In one or more of such embodiments, the tubular cut monitoring system adjusts the threshold number of tolerable stick slip vibrations and/or the threshold number of revolutions of the cutter blade based on one or more cutting parameters including, but not limited to, the material of the tubular, dimensions of the tubular, location of the tubular, history of prior cut failures, as well as other cutting parameters. Additional descriptions of tubular cut monitoring systems and methods to cut a tubular are provided in the paragraphs below and are illustrated in FIGS. 1-5.

FIG. 1 is a schematic, side view of a completion environment 100 that includes a wellbore 114 having a downhole cutting tool 122 deployed in a tubular 116 via a wireline 118 to perform a cutting operation. As shown in FIG. 1, wellbore 114 has a vertical section 115 that extends from a wellhead 106 at a surface 108 downwards to a formation 127, and a lateral section 117 that extends laterally or horizontally through formation 127. A wireline vehicle 150 is positioned near wellhead 106 to deploy wireline 118 through wellhead 106 into wellbore 114. A lubricator 155 is positioned above wellhead 106 to facilitate lowering wireline 118 down wellbore 114 and lifting wireline 118 up from wellhead 106 of a well 102.

In the embodiment of FIG. 1, downhole cutting tool 122 has a cutter blade 126, a cutter head 124, and an inertial sensor 128 positioned in cutter head 124 and configured to detect and monitor for stick slip vibrations produced by cutter blade 126, and transmit cutting operation data via wireline 118 to downhole cut monitoring system 184. As referred to herein, downhole cut monitoring system 184 includes any electronic device having a storage medium and processors configured to perform operations to determine, based on the data obtained by inertial sensor 128, a number of stick slip vibrations produced by cutter blade 126, determine whether a total number of stick slip vibrations produced by cutter blade 126 within a threshold number of revolutions of the cutter blade is greater than a threshold number of tolerable stick slip vibrations, and in response to a determination that the total number of stick slip vibrations produced by cutter blade 126 within the threshold number of revolutions is greater than the threshold number of tolerable stick slip vibrations, request downhole cutting tool 122 to cease the cutting operation. Examples of downhole cut monitoring system 184 include, but are not limited to, desktop computers, laptop computers, tablet devices, smartphones, server systems, and other types of electronic devices configured to perform the foregoing operations. In the embodiment of FIG. 1, downhole cut monitoring system 184 provides real-time data indicative of the cutting operation including, but not limited to, the current status of the cutting operation, the velocity magnitude of the cutter blade, the total number of stick slip vibrations produced by the cutter blade within the threshold number of revolutions, history of the cutting operation including successful and failed cuts, as well as other cutting operation data for display to an operator. In some embodiments, where the operator inputs instructions to change the threshold number of tolerable stick slip vibrations within the threshold number of revolutions of cutter blade 126, downhole cut monitoring system 184 resets the threshold number of tolerable stick slip vibrations to the operator designated number. In some embodiments, where the operator inputs instructions to make one or more adjustments to the cutting operation, downhole cut monitoring system 184 relays the operator's instructions via wireline 118 to downhole cutting tool 122. In some embodiments, where an operator is not present, downhole cut monitoring system 184 is configured to dynamically adjust the threshold number of tolerable stick slip vibrations within the threshold number of revolutions of cutter blade 126 based on one or more cutting parameters, history and conditions of downhole cutting tool 122 and cutter blade 126, and the history of cutting operations performed by downhole cutting tool 122. For example, downhole cut monitoring system 184 in response to a determination that cutter blade 126 previously made a failed cut at the location illustrated in FIG. 1, dynamically reduces the number of tolerable stick slip vibrations within the threshold number of revolutions of cutter blade 126 to prevent damage to cutter blade 126.

Although FIG. 1 illustrates downhole cut monitoring system 184 as a surface-based electronic device, in some embodiments, downhole cut monitoring system 184 is a component of downhole cutting tool 122, and is configured to perform operations described herein while being deployed in wellbore 114. In some embodiments, downhole cut monitoring system 184 is deployed in another downhole location of wellbore 114. In some embodiments, certain components of downhole cut monitoring system 184 are deployed downhole while other components are deployed on surface 108 or in the cloud.

Although FIG. 1 illustrates downhole cutting tool 122 run in hole via wireline 118, in some embodiments, downhole cutting tool is run downhole via another type of conveyance such as another tubular, pipe, coiled tubing, or a different type of conveyance. Further, although FIG. 1 illustrates a cased wellbore, downhole cutting tool 122, illustrated in FIG. 1, as well as other downhole cutting tools described herein, are deployable in open-hole wellbores, and cased wellbores and open-hole wellbores of offshore wells. Further, although FIG. 1 illustrates downhole cutting tool 122 deployed in lateral section 117 of wellbore 114, in some embodiments, operations described herein are performed while downhole cutting tool 122 is located in vertical section 115 of wellbore 114, or in a transition section of wellbore 114. Further, although FIG. 1 illustrates a completion environment 100, downhole cutting tool positioning assembly 122 and other downhole cutting tool positioning assemblies described herein are also deployable in other well environments to make tubular cuts.

Figure 2:
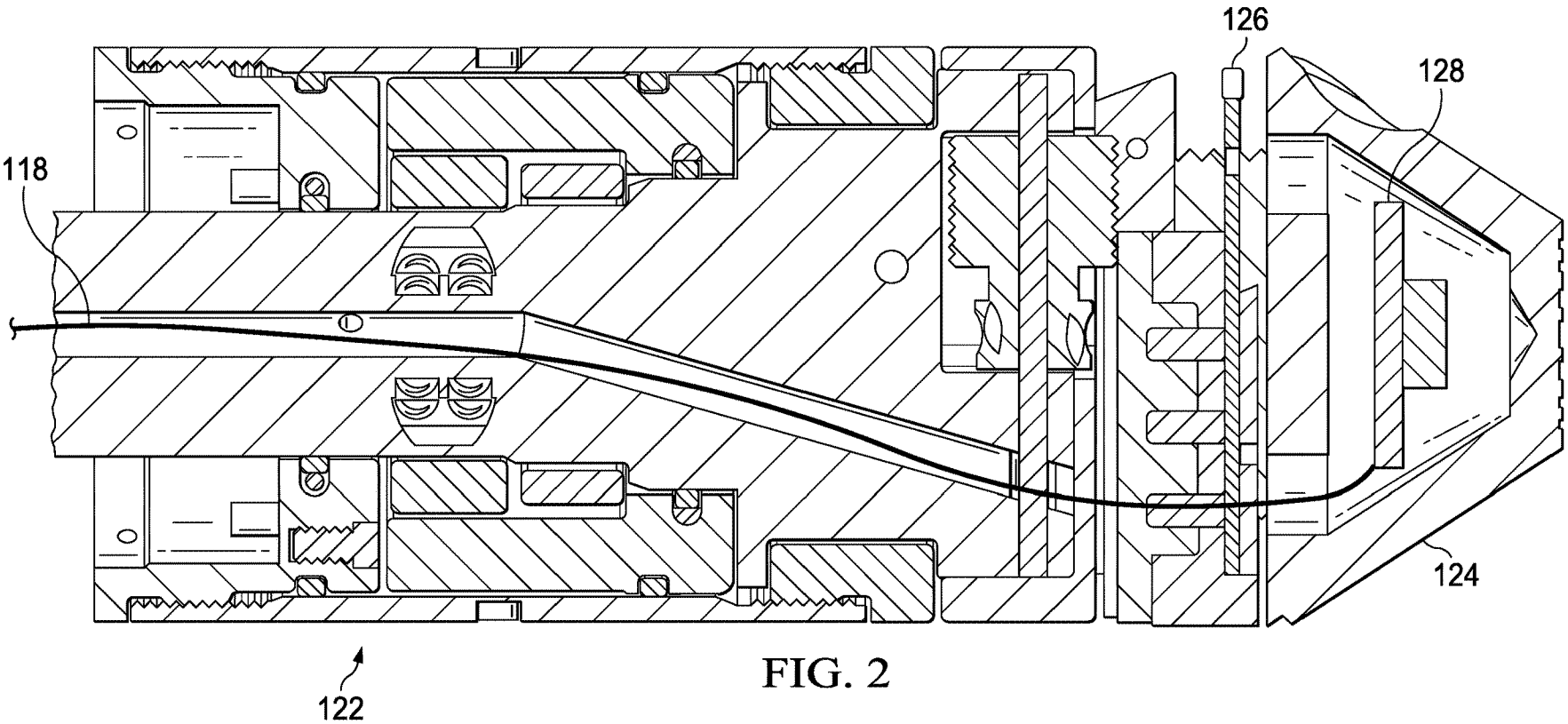
FIG. 2 is a cross-sectional view of a cutter head of the downhole cutting tool of FIG. 1.

FIG. 2 is a cross-sectional view of a cutter head 124 of downhole cutting tool 122 of FIG. 1. In the embodiment of FIG. 2, inertial sensor 128 is positioned in a cutter head 124 of downhole cutting tool 122. Moreover, inertial sensor 128 is connected to wireline 118 to provide direct real-time transmission of data indicative stick slip vibrations produced by a cutter blade and other cutting operation data obtained by inertial sensor 128. In some embodiments, inertial sensor is an accelerometer. In some embodiments, inertial sensor 128 is a gyroscope. In some embodiments, multiple inertial sensors are positioned in cutter head 124 to monitor for stick slip vibrations produced by cutter blade 126 during a cutting operation. In some embodiments, additional sensors (not shown) configured to detect and obtain cutting operation data are positioned in cutter head 124 or a body of downhole cutting tool 122. In some embodiments, tubular cut monitoring system 184, and other components such as, but not limited to, transmitters, receivers, transceivers, analog to digital convertors, digital to analog convertors, encoders, and decoders, are also position within cutter head 124 or the body. Although FIG. 2 illustrates inertial sensor 128 connected to wireline 118, in some embodiments, inertial sensor 128 provides cutting operation data to a transmitter or transceiver (not shown) that is configured to transmit the cutting operation data uphole. Further, although FIG. 2 illustrates a single cutter blade 126, in some embodiments, downhole cutting tool 122 includes multiple cutter blades (not shown) that are used to make different types of cuts.

Figure 3A:
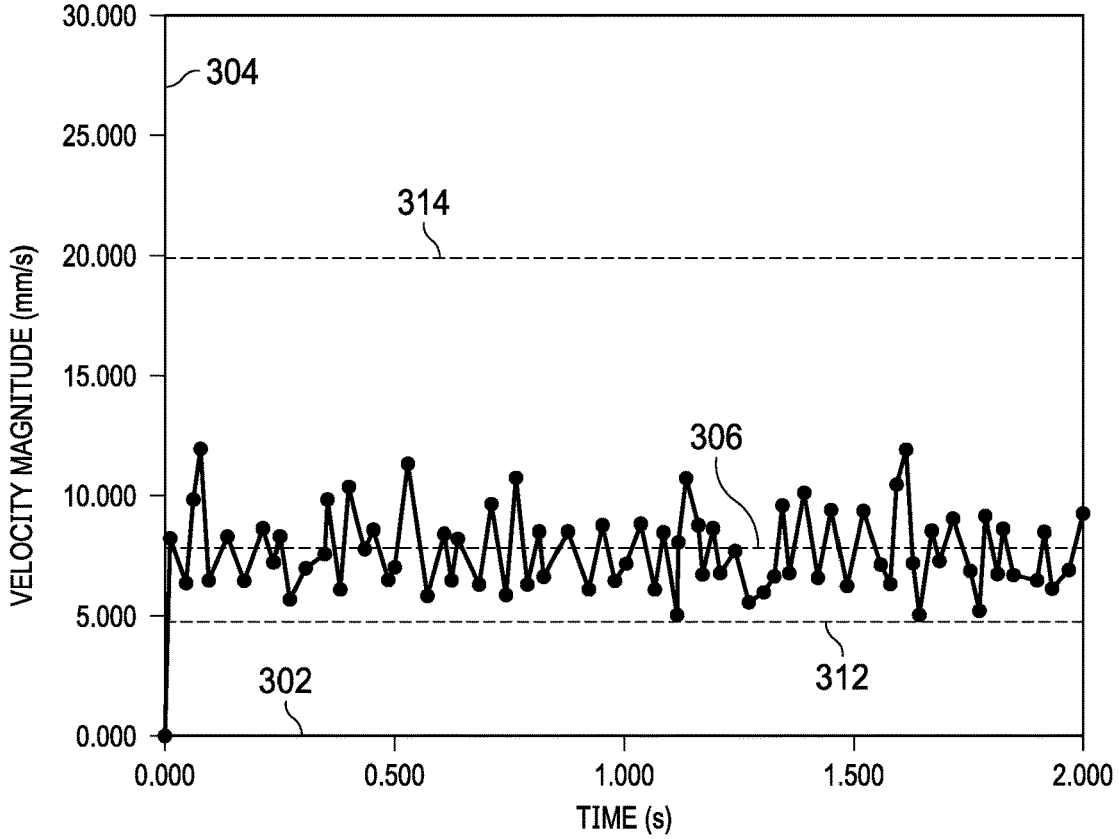
FIG. 3A is a chart illustrating the velocity magnitude of a cutter blade during a successful cutting operation.
Figure 3B:
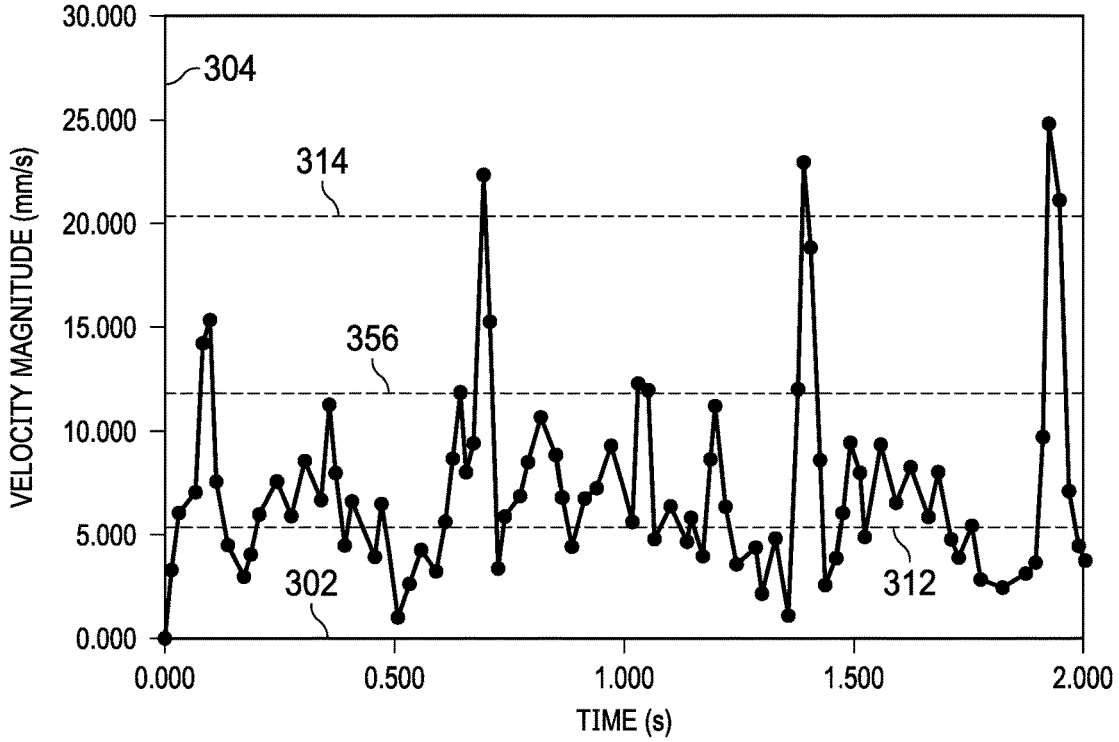
FIG. 3B is a chart illustrate the velocity magnitude of the cutter blade of FIG. 3A during a failed cutting operation.

FIG. 3A is a chart illustrating the velocity magnitude of a cutter blade, such as cutter blade 128 of FIG. 1, during a successful cutting operation. Further, FIG. 3B is a chart illustrate the velocity magnitude of the cutter blade of FIG. 3A during a failed cutting operation. In the embodiment of FIGS. 3A and 3B, axis 302 represents time during a cutting operation, whereas axis 304 represents the velocity magnitude of the cutter blade in millimeters per second. Moreover line 306 represents the velocity magnitude of a cutter blade from time 0.000 second to time 2.000 seconds, whereas line 356 represents the velocity magnitude of a cutter blade from time 0.000 second to time 2.000 seconds. Further, line 312 represents a first threshold velocity magnitude, whereas line 314 represents a second threshold velocity magnitude that is higher than the first threshold velocity magnitude by a third threshold velocity magnitude, where the first threshold velocity magnitude is 5.000 millimeters per second, the second threshold velocity magnitude is 20.000 millimeters per second, and the third velocity magnitude is 15 millimeters per second.

As illustrated in FIG. 3A, after time 0.000 seconds, the velocity magnitude of the cutter blade increases from 0.000 millimeters per second at the beginning of the cutting operation and remains almost entirely above the first threshold velocity magnitude, and never above the second threshold velocity magnitude. The foregoing indicates that no stick slip vibration was produced by the cutter blade from time 0.000 second and time 2.000 seconds. Further, as illustrated in FIG. 3B, after time 0.000 seconds, the velocity magnitude of the cutter blade increases from below the first threshold velocity magnitude to above the second threshold velocity magnitude three times, which indicates that stick slip vibrations were produced by the cutter blade three times from time 0.000 second to time 2.000 seconds. In some embodiments, where stick slip vibration occurs if the velocity magnitude of the cutter blade increases to above the second threshold velocity magnitude after being below the first threshold velocity magnitude for more than a threshold period of time (e.g., 0.1 seconds), the amount of time that the velocity magnitude of the cutter blade remains below the first threshold velocity is also analyzed to determine the number of times stick slip vibrations were produced by the cutter blade. For example, where the threshold period of time is 0.1 seconds, FIG. 3B illustrates the cutter blade's velocity magnitude dropping below 5.000 millimeters per second at approximately time 0.400 seconds and remaining below 5.000 millimeters per second for approximately 0.300 seconds before jumping above the second threshold velocity magnitude, which indicates stick slip velocity produced by the cutter blade.

In some embodiments, where the threshold tolerable number of stick slip vibrations is two stick slip vibrations between time 0.000 seconds and time 2.000 seconds, line 356 indicates that the cutter blade has produced more than the threshold tolerable number of stick slip vibrations and the cutting operation should cease to protect the cutter blade. Although FIGS. 3A and 3B illustrate the first threshold velocity magnitude being 5.000 millimeters per second, and the second threshold velocity magnitude being 20.000 millimeters per second, the values of the first threshold velocity magnitude and the second threshold velocity magnitude are adjustable by the tubular cut monitoring system, such as tubular cut monitoring system 184 based on operator request, and are dynamically adjustable by the tubular cut monitoring system based on one or more cutting parameters including, but not limited to, the material of the tubular, dimensions of the tubular, location of the tubular, history of prior cut failures, as well as other cutting parameters.

Figure 4:
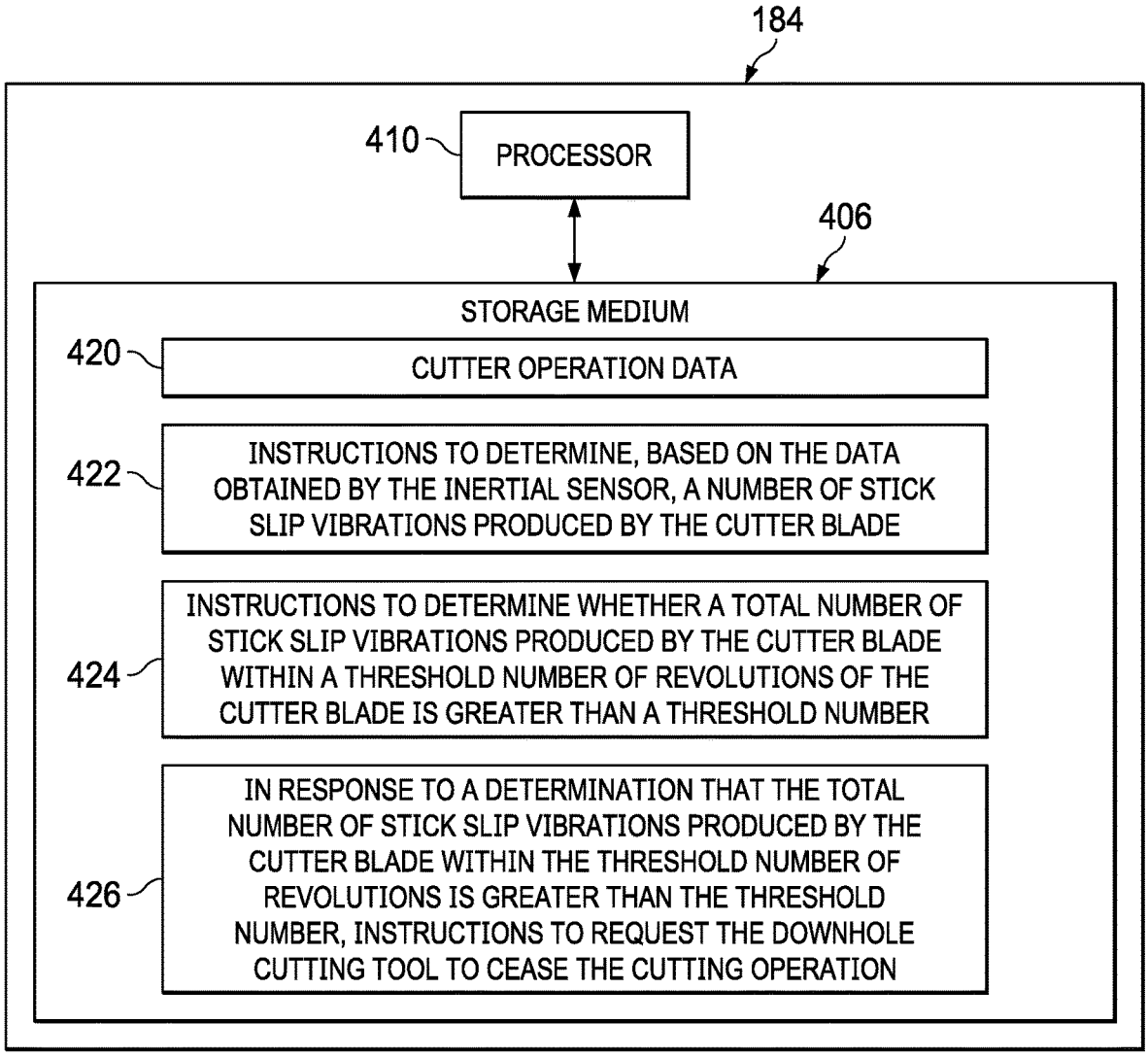
FIG. 4 is a system diagram of the tubular cut monitoring system of FIG. 1.

FIG. 4 is a system diagram of tubular cut monitoring system 184 of FIG. 1. The system 104 includes a storage medium 406 and a processor 410. The storage medium 406 may be formed from data storage components such as, but not limited to, read-only memory (ROM), random access memory (RAM), flash memory, magnetic hard drives, solid state hard drives, CD-ROM drives, DVD drives, floppy disk drives, as well as other types of data storage components and devices. In some embodiments, storage medium 406 includes multiple data storage devices. In further embodiments, the multiple data storage devices may be physically stored at different locations. Cutter operation data are stored at a first location 420 of storage medium 406. Further, instructions to determine, based on the data obtained by the inertial sensor, a number of stick slip vibrations produced by the cutter blade are stored at a second location 422 of storage medium 406. Further, instructions to analyze the plurality of frames to detect the object of interest are storage at a third location 424 of storage medium 406. Further, instructions to determine whether a total number of stick slip vibrations produced by the cutter blade within a threshold number of revolutions of the cutter blade is greater than a threshold number of tolerable stick slip vibrations are stored at a fourth location 426 of storage medium 406. Further, and in response to a determination that the total number of stick slip vibrations produced by the cutter blade within the threshold number of revolutions is greater than the threshold number, instructions to request the downhole cutting tool to cease the cutting operation are stored in other locations of the storage medium 406. Additional instructions of operations performed by tubular cut monitoring system 184 and other tubular cut monitoring systems described herein are also stored at other locations of storage medium 406.

Figure 5:
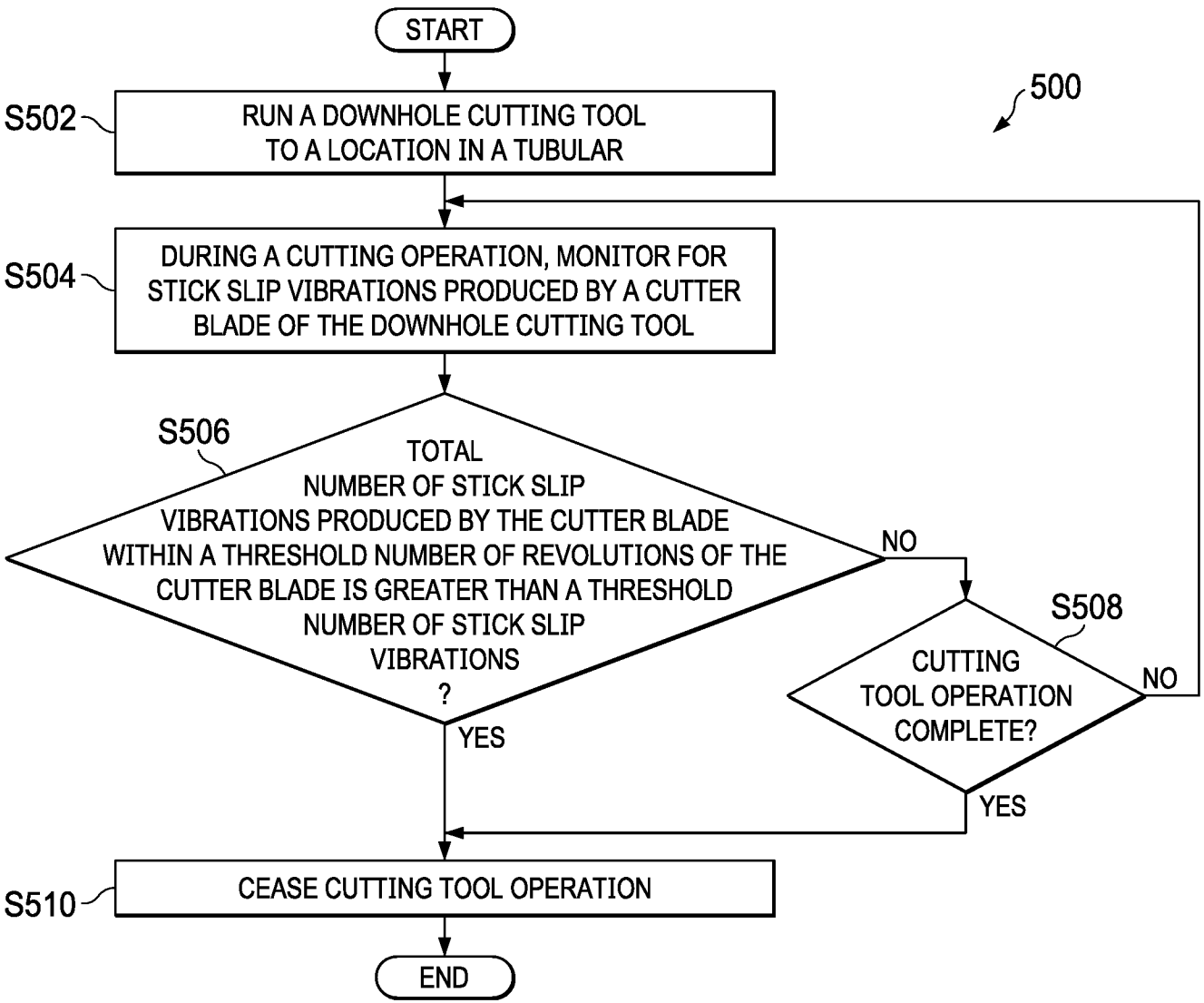
FIG. 5 is a flow chart illustrating a process to cut a tubular.

FIG. 5 is a flow chart of a process 500 to cut a tubular. Although the operations in process 700 are shown in a particular sequence, certain operations may be performed in different sequences or at the same time where feasible. At block S502, a downhole cutting tool is run downhole to a location in a tubular. FIG. 1 illustrates running cutting tool 122 into tubular 116. At block S504, stick slip vibrations produced by a cutter blade of the downhole cutting tool is monitored during a cutting operation. FIG. 1 illustrates tubular cut monitoring system 184 monitoring a cutting operation performed by cutter blade 128 in real-time. At block S506, a determination is made on whether the total number of stick slip vibrations produced by the cutter blade within a threshold number of revolutions of the cutter blade is greater than a threshold number of tolerable stick slip vibrations. In the embodiment of FIGS. 3A and 3B, the tubular cut monitoring system determines the velocity magnitude of the cutter blade and determines the number of times the velocity magnitude of the cutter blade increased from being below the first threshold velocity magnitude to above the second threshold velocity magnitude, where the number of times the velocity magnitude of the cutter blade increased from being below the first threshold velocity magnitude to above the second threshold velocity magnitude within the threshold number of revolutions of the cutter blade is the total number of stick slip vibrations produced by the cutter blade within the threshold number of revolutions. In response to a determination that total number of stick slip vibrations produced by the cutter blade within the threshold number of revolutions of the cutter blade is not greater than the threshold number of tolerable stick slip vibrations, the process proceeds to block S508, and a determination of whether the cutting tool operation is complete is made. Alternatively, at block S506 and in response to a determination that the total number of stick slip vibrations produced by the cutter blade within the threshold number of revolutions of the cutter blade is greater than the threshold number of tolerable stick slip vibrations, the process proceeds to block S510, and the cutting operation is ceased.

At block S508, and in response to a determination that the cutting tool operation is not complete, the process returns to block S504. Alternatively, at block S508, and in response to a determination that the cutting tool operation is complete, the process proceeds to block S510, and the cutting operation is ceased. In some embodiments, after completing a tubular cut, the downhole cutting tool is moved to a second location of the tubular to perform a second tubular cut. In one or more of such embodiments, process 500 is repeated to perform the second tubular cut. In one or more of such embodiments, the threshold number of tolerable stick slip vibrations at the second tubular location is adjusted based on one or more cutting parameters. In some embodiments, where the cutting operation ceased without completing the tubular cut, the cutting operation is resumed, and process 500 is subsequently repeated starting at block S504 to complete the tubular cut. In one or more of such embodiments, the threshold number of tolerable stick slip vibrations is adjusted or reduced during second or sequent attempts to perform the tubular cut to protect the cutter blade and the tubular.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a method to cut a tubular, the method includes running a downhole cutting tool to a location in a tubular; during a cutting operation, monitoring, with an inertial sensor of the downhole cutting tool, for stick slip vibrations produced by a cutter blade of the downhole cutting tool; determining whether a total number of stick slip vibrations produced by the cutter blade within a threshold number of revolutions of the cutter blade is greater than a threshold number of tolerable stick slip vibrations; and in response to a determination that the total number of stick slip vibrations produced by the cutter blade within the threshold number of revolutions is greater than the threshold number of tolerable stick slip vibrations, ceasing the cutting operation.

Clause 2, the method of clause 1, further comprising: determining a velocity magnitude of the cutter blade during the cutting operation; and determining occurrence of an instance of a stick slip vibration of the stick slip vibrations based on a change to the velocity magnitude of the cutter blade.

Clause 3, the method of clause 2, further comprising: determining whether the velocity magnitude of the cutter blade is below a first threshold velocity magnitude; and in response to a determination that the velocity magnitude of the cutter blade is below the first threshold velocity magnitude, determining whether the velocity magnitude of the cutter blade increases from below the first threshold velocity magnitude to above a second threshold velocity magnitude that is higher than the first threshold velocity magnitude by a third threshold velocity magnitude, wherein determining occurrence of the instance of stick slip vibration comprises determining occurrence of the instance of stick slip vibration in response to a determination that the velocity magnitude increased from below the first threshold velocity magnitude to above the second threshold velocity magnitude.

Clause 4, the method of clause 3, further comprising: in response to a determination that the velocity magnitude increased from below the first threshold velocity magnitude to above the second threshold velocity magnitude, determining whether the velocity magnitude subsequently decreases from above the second threshold velocity magnitude to below the first threshold velocity magnitude; in response to a determination that the velocity magnitude decreased from above the second threshold velocity magnitude to below the first threshold velocity magnitude, determining whether the velocity magnitude of the cutter blade increases a second time from below the first threshold velocity magnitude to above the second threshold velocity magnitude; and determining occurrence of a second instance of stick slip vibration in response to a determination that the velocity magnitude of the cutter blade increased the second time from below the first threshold velocity magnitude to above the second threshold velocity magnitude.

Clause 5, the method of clause 4, further comprising incrementing a number of instances of stick slip velocity in response to each determination that the velocity magnitude increased from below the first threshold velocity magnitude to above the second threshold velocity magnitude within the threshold number of revolutions of the cutter blade.

Clause 6, the method of any of clauses 1-5, wherein the inertial sensor is an accelerometer, and wherein monitoring for stick slip of the cutter blade comprises monitoring for stick slip of the cutter blade with an accelerometer.

Clause 7, the method of any of clauses 1-5, wherein the inertial sensor is a gyroscope, and wherein monitoring for stick slip of the cutter blade comprises monitoring for stick slip of the cutter blade with a gyroscope.

Clause 8, the method of any of clauses 1-7, further comprising continuing the cutting operation in response to a determination that the total number of stick slip vibrations produced by the cutter blade within the threshold number of revolutions of the cutter blade is not greater than the threshold number of tolerable stick slip vibrations.

Clause 9, the method of any of clauses 1-8, further comprising: after completing the cutting operation, running the downhole cutting tool to a second location in the tubular; during a second cutting operation, monitoring, with the inertial sensor of the downhole cutting tool, for stick slip vibrations produced by the cutter blade of the downhole cutting tool; determining whether the total number of stick slip vibrations produced by the cutter blade within the threshold number of revolutions of the cutter blade is greater than a second threshold number of tolerable stick slip vibrations; and in response to a second determination that the total number of stick slip vibrations produced by the cutter blade within the threshold number of revolutions is greater than the second threshold number of tolerable stick slip vibrations, ceasing the second cutting operation.

Clause 10, the method of any of clauses 1-9, further comprising: after ceasing the cutting operation for a threshold period of time, resuming the cutting operation; after resuming the cutting operation, monitoring, with the inertial sensor of the downhole cutting tool, for stick slip vibrations produced by the cutter blade of the downhole cutting tool; determining whether the total number of stick slip vibrations produced by the cutter blade within the threshold number of revolutions of the cutter blade is greater than a second threshold number of tolerable stick slip vibrations; and in response to a determination that the total number of stick slip vibrations produced by the cutter blade within the threshold number of revolutions is greater than the second threshold number of tolerable stick slip vibrations, ceasing the cutting operation a second time.

Clause 11, the method of any of clauses 1-10, further comprising providing a current status of the cutting operation including the total number of stick slip vibrations produced by the cutter blade within the threshold number of revolutions for display.

Clause 12, a tubular cut monitoring system, comprising: an inertial sensor disposed in a cutter head of a downhole cutting tool and configured to obtain data indicative of stick slip vibrations produced by a cutter blade of the downhole cutting tool during a cutting operation; storage medium; and one or more processors configured to: determine, based on the data obtained by the inertial sensor, a number of stick slip vibrations produced by the cutter blade; determine whether a total number of stick slip vibrations produced by the cutter blade within a threshold number of revolutions of the cutter blade is greater than a threshold number of tolerable stick slip vibrations; and in response to a determination that the total number of stick slip vibrations produced by the cutter blade within the threshold number of revolutions is greater than the threshold number of tolerable stick slip vibrations, request the downhole cutting tool to cease the cutting operation.

Clause 13, the tubular cut monitoring system of clause 12, wherein the processors are further configured to: determine a velocity magnitude of the cutter blade during the cutting operation; and determine occurrence of an instance of a stick slip vibration of the stick slip vibrations based on a change to the velocity magnitude of the cutter blade.

Clause 14, the tubular cut monitoring system of clause 13, wherein the processors are further configured to: determine whether the velocity magnitude of the cutter blade is below a first threshold velocity magnitude; in response to a determination that the velocity magnitude of the cutter blade is below the first threshold velocity magnitude, determine whether the velocity magnitude of the cutter blade increases from below the first threshold velocity magnitude to above a second threshold velocity magnitude that is higher than the first threshold velocity magnitude by a third threshold velocity magnitude; and determine occurrence of the instance of stick slip vibration in response to a determination that the velocity magnitude increased from below the first threshold velocity magnitude to above the second threshold velocity magnitude.

Clause 15, the tubular cut monitoring system of clause 14, wherein the processors are further configured to: in response to a determination that the velocity magnitude increased from below the first threshold velocity magnitude to above the second threshold velocity magnitude, determine whether the velocity magnitude subsequently decreases from above the second threshold velocity magnitude to below the first threshold velocity magnitude; in response to a determination that the velocity magnitude decreased from above the second threshold velocity magnitude to below the first threshold velocity magnitude, determine whether the velocity magnitude of the cutter blade increases a second time from below the first threshold velocity magnitude to above the second threshold velocity magnitude; and determine occurrence of a second instance of stick slip vibration in response to a determination that the velocity magnitude of the cutter blade increased the second time from below the first threshold velocity magnitude to above the second threshold velocity magnitude.

Clause 16, the tubular cut monitoring system of clause 15, wherein the processors are further configured to increment a number of instances of stick slip velocity in response to each determination that the velocity magnitude increased from below the first threshold velocity magnitude to above the second threshold velocity magnitude within the threshold number of revolutions of the cutter blade.

Clause 17, the tubular cutting monitoring system of any of clauses 12-16, wherein the processors are further configured to provide a current status of the cutting operation including the total number of stick slip vibrations produced by the cutter blade within the threshold number of revolutions for display.

Clause 18, the tubular cut monitoring system of clauses 12-17, wherein the processors are further configured to dynamically adjust a value of the threshold number of tolerable stick slip vibrations based on one or more cutting parameters.

Clause 19, a non-transitory computer-readable medium comprising instructions, which when executed by one or more processors, cause the one or more processes to perform operations comprising: during a cutting operation, monitoring, with an inertial sensor of a downhole cutting tool, for stick slip vibrations produced by a cutter blade of the downhole cutting tool; determining, based on data obtained by the inertial sensor, a number of stick slip vibrations produced by the cutter blade; determining whether a total number of stick slip vibrations produced by the cutter blade within a threshold number of revolutions of the cutter blade is greater than a threshold number of tolerable stick slip vibrations; and in response to a determination that the total number of stick slip vibrations produced by the cutter blade within the threshold number of revolutions is greater than the threshold number of tolerable stick slip vibrations, requesting the downhole cutting tool to cease the cutting operation.

Clause 20, the non-transitory computer-readable medium of clause 19, further comprising instructions, which when executed by one or more processors, cause the one or more processes to perform operations comprising: determining a velocity magnitude of the cutter blade during the cutting operation; and determining occurrence of an instance of a stick slip vibration of the stick slip vibrations based on a change to the velocity magnitude of the cutter blade.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A method to cut a tubular, the method comprising:

running a downhole cutting tool to a location in a tubular;

during a cutting operation, monitoring, with an inertial sensor of the downhole cutting tool, for stick slip vibrations produced by a cutter blade of the downhole cutting tool;

determining a velocity magnitude of the cutter blade during the cutting operation; and determining occurrence of an instance of a stick slip vibration of the stick slip vibrations based on a change to the velocity magnitude of the cutter blade;

determining whether a total number of stick slip vibrations produced by the cutter blade within a threshold number of revolutions of the cutter blade is greater than a threshold number of tolerable stick slip vibrations; and in response to a determination that the total number of stick slip vibrations produced by the cutter blade within the threshold number of revolutions is greater than the threshold number of tolerable stick slip vibrations, ceasing the cutting operation.

2. The method of claim 1, further comprising:

determining whether the velocity magnitude of the cutter blade is below a first threshold velocity magnitude; and in response to a determination that the velocity magnitude of the cutter blade is below the first threshold velocity magnitude, determining whether the velocity magnitude of the cutter blade increases from below the first threshold velocity magnitude to above a second threshold velocity magnitude that is higher than the first threshold velocity magnitude by a third threshold velocity magnitude, wherein determining occurrence of the instance of stick slip vibration comprises determining occurrence of the instance of stick slip vibration in response to a determination that the velocity magnitude increased from below the first threshold velocity magnitude to above the second threshold velocity magnitude.

3. The method of claim 2, further comprising:

in response to a determination that the velocity magnitude increased from below the first threshold velocity magnitude to above the second threshold velocity magnitude, determining whether the velocity magnitude subsequently decreases from above the second threshold velocity magnitude to below the first threshold velocity magnitude;

in response to a determination that the velocity magnitude decreased from above the second threshold velocity magnitude to below the first threshold velocity magnitude, determining whether the velocity magnitude of the cutter blade increases a second time from below the first threshold velocity magnitude to above the second threshold velocity magnitude; and determining occurrence of a second instance of stick slip vibration in response to a determination that the velocity magnitude of the cutter blade increased the second time from below the first threshold velocity magnitude to above the second threshold velocity magnitude.

4. The method of claim 3, further comprising incrementing a number of instances of stick slip velocity in response to each determination that the velocity magnitude increased from below the first threshold velocity magnitude to above the second threshold velocity magnitude within the threshold number of revolutions of the cutter blade.

5. The method of claim 1, wherein the inertial sensor is an accelerometer, and wherein monitoring for stick slip of the cutter blade comprises monitoring for stick slip of the cutter blade with an accelerometer.

6. The method of claim 1, wherein the inertial sensor is a gyroscope, and wherein monitoring for stick slip of the cutter blade comprises monitoring for stick slip of the cutter blade with a gyroscope.

7. The method of claim 1, further comprising continuing the cutting operation in response to a determination that the total number of stick slip vibrations produced by the cutter blade within the threshold number of revolutions of the cutter blade is not greater than the threshold number of tolerable stick slip vibrations.

8. The method of claim 1, further comprising:

after completing the cutting operation, running the downhole cutting tool to a second location in the tubular;

during a second cutting operation, monitoring, with the inertial sensor of the downhole cutting tool, for stick slip vibrations produced by the cutter blade of the downhole cutting tool;

determining whether the total number of stick slip vibrations produced by the cutter blade within the threshold number of revolutions of the cutter blade is greater than a second threshold number of tolerable stick slip vibrations; and in response to a second determination that the total number of stick slip vibrations produced by the cutter blade within the threshold number of revolutions is greater than the second threshold number of tolerable stick slip vibrations, ceasing the second cutting operation.

9. The method of claim 1, further comprising:

after ceasing the cutting operation for a threshold period of time, resuming the cutting operation;

after resuming the cutting operation, monitoring, with the inertial sensor of the downhole cutting tool, for stick slip vibrations produced by the cutter blade of the downhole cutting tool;

determining whether the total number of stick slip vibrations produced by the cutter blade within the threshold number of revolutions of the cutter blade is greater than a second threshold number of tolerable stick slip vibrations; and in response to a determination that the total number of stick slip vibrations produced by the cutter blade within the threshold number of revolutions is greater than the second threshold number of tolerable stick slip vibrations, ceasing the cutting operation a second time.

10. The method of claim 1, further comprising providing a current status of the cutting operation including the total number of stick slip vibrations produced by the cutter blade within the threshold number of revolutions for display.

11. A tubular cut monitoring system, comprising:

an inertial sensor disposed in a cutter head of a downhole cutting tool and configured to obtain data indicative of stick slip vibrations produced by a cutter blade of the downhole cutting tool during a cutting operation;

storage medium; and one or more processors configured to:

determine, based on the data obtained by the inertial sensor, a number of stick slip vibrations produced by the cutter blade;

determine a velocity magnitude of the cutter blade during the cutting operation; and determine occurrence of an instance of a stick slip vibration of the stick slip vibrations based on a change to the velocity magnitude of the cutter blade;

determine whether a total number of stick slip vibrations produced by the cutter blade within a threshold number of revolutions of the cutter blade is greater than a threshold number of tolerable stick slip vibrations; and in response to a determination that the total number of stick slip vibrations produced by the cutter blade within the threshold number of revolutions is greater than the threshold number of tolerable stick slip vibrations, request the downhole cutting tool to cease the cutting operation.

12. The tubular cut monitoring system of claim 11, wherein the processors are further configured to:

determine whether the velocity magnitude of the cutter blade is below a first threshold velocity magnitude;

in response to a determination that the velocity magnitude of the cutter blade is below the first threshold velocity magnitude, determine whether the velocity magnitude of the cutter blade increases from below the first threshold velocity magnitude to above a second threshold velocity magnitude that is higher than the first threshold velocity magnitude by a third threshold velocity magnitude; and determine occurrence of the instance of stick slip vibration in response to a determination that the velocity magnitude increased from below the first threshold velocity magnitude to above the second threshold velocity magnitude.

13. The tubular cut monitoring system of claim 12, wherein the processors are further configured to:

in response to a determination that the velocity magnitude increased from below the first threshold velocity magnitude to above the second threshold velocity magnitude, determine whether the velocity magnitude subsequently decreases from above the second threshold velocity magnitude to below the first threshold velocity magnitude;

in response to a determination that the velocity magnitude decreased from above the second threshold velocity magnitude to below the first threshold velocity magnitude, determine whether the velocity magnitude of the cutter blade increases a second time from below the first threshold velocity magnitude to above the second threshold velocity magnitude; and determine occurrence of a second instance of stick slip vibration in response to a determination that the velocity magnitude of the cutter blade increased the second time from below the first threshold velocity magnitude to above the second threshold velocity magnitude.

14. The tubular cut monitoring system of claim 13, wherein the processors are further configured to increment a number of instances of stick slip velocity in response to each determination that the velocity magnitude increased from below the first threshold velocity magnitude to above the second threshold velocity magnitude within the threshold number of revolutions of the cutter blade.

15. The tubular cut monitoring system of claim 11, wherein the processors are further configured to provide a current status of the cutting operation including the total number of stick slip vibrations produced by the cutter blade within the threshold number of revolutions for display.

16. The tubular cut monitoring system of claim 11, wherein the processors are further configured to dynamically adjust a value of the threshold number of tolerable stick slip vibrations based on one or more cutting parameters.

17. A non-transitory computer-readable medium comprising instructions, which when executed by one or more processors, cause the one or more processors to perform operations comprising:

during a cutting operation, monitoring, with an inertial sensor of a downhole cutting tool, for stick slip vibrations produced by a cutter blade of the downhole cutting tool;

determining, based on data obtained by the inertial sensor, a number of stick slip vibrations produced by the cutter blade;

determining a velocity magnitude of the cutter blade during the cutting operation; and determining occurrence of an instance of a stick slip vibration of the stick slip vibrations based on a change to the velocity magnitude of the cutter blade;

determining whether a total number of stick slip vibrations produced by the cutter blade within a threshold number of revolutions of the cutter blade is greater than a threshold number of tolerable stick slip vibrations; and in response to a determination that the total number of stick slip vibrations produced by the cutter blade within the threshold number of revolutions is greater than the threshold number of tolerable stick slip vibrations, requesting the downhole cutting tool to cease the cutting operation.

* * * * *